US007688217B2

(12) United States Patent
Rong et al.

(10) Patent No.: US 7,688,217 B2
(45) Date of Patent: Mar. 30, 2010

(54) SYSTEM AND METHOD FOR DETECTING AND MONITORING SHELL CRACKS ON FREIGHT CONTAINERS

(75) Inventors: Liu Rong, Jiangsu (CN); Zhou Chenguang, Jiangsu (CN); Yuan Wenqing, Jiangsu (CN); Chen Xiaochun, Jiangsu (CN); Zhou Shouqin, Shenzhen (CN); Zhu Jianbin, Jiangsu (CN)

(73) Assignees: China International Marine Containers (Group) Co., Ltd., Shenzhen (CN); Nantong Cimc Special Transportation Equipment Manufacture Co., Ltd., Nantong (CN)

( * ) Notice: Subject to any disclaimer, the term of this patent is extended or adjusted under 35 U.S.C. 154(b) by 367 days.

(21) Appl. No.: 11/464,768

(22) Filed: Aug. 15, 2006

(65) Prior Publication Data

US 2007/0040675 A1 Feb. 22, 2007

(30) Foreign Application Priority Data

Aug. 17, 2005 (CN) ..... 2005 1 0036731

(51) Int. Cl.
*G08B 21/00* (2006.01)

(52) U.S. Cl. ..... 340/657; 340/500; 340/540; 340/539.26; 340/539.1

(58) Field of Classification Search ..... 340/657
See application file for complete search history.

(56) References Cited

U.S. PATENT DOCUMENTS

| | | | | |
|---|---|---|---|---|
| 6,895,509 | B1 * | 5/2005 | Clark | 726/23 |
| 7,133,800 | B2 * | 11/2006 | Delin et al. | 702/125 |
| 7,378,962 | B2 * | 5/2008 | Odenwald et al. | 340/539.22 |
| 2003/0164763 | A1 * | 9/2003 | Hisano et al. | 340/539.13 |
| 2004/0189466 | A1 * | 9/2004 | Morales | 340/539.26 |
| 2005/0073406 | A1 * | 4/2005 | Easley et al. | 340/539.1 |
| 2005/0275537 | A1 * | 12/2005 | Kerr et al. | 340/568.2 |
| 2006/0071786 | A1 * | 4/2006 | Fano | 340/539.22 |

* cited by examiner

*Primary Examiner*—Toan N Pham
*Assistant Examiner*—Kerri McNally

(57) ABSTRACT

A device system and method for detecting shell cracks on a container. The device has a plurality of sensing units, an interface circuit, a receiver module, a CPU and alarm unit. A signal is generated from the sensing unit and transmitted to the CPU via an interface circuit and receiver module. An output signal from the CPU is transmitted to the alarm unit. The plurality of sensing units is distributed in an internal surface of the container. In addition, each sensing unit corresponds to an identification code. The present invention incorporates mechanical and electron information technology together. It can perform a real-time monitoring and rapid detection for container security.

11 Claims, 5 Drawing Sheets

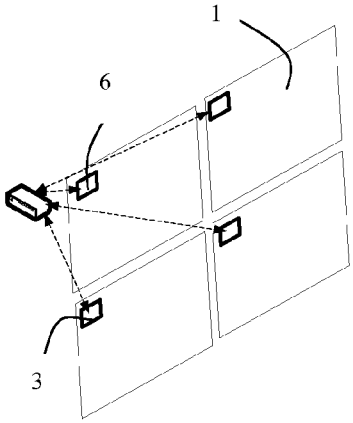
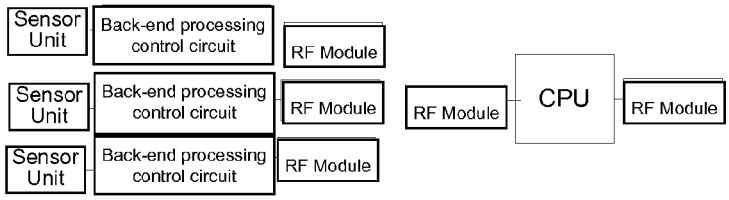
Figure 4A
Figure 4B
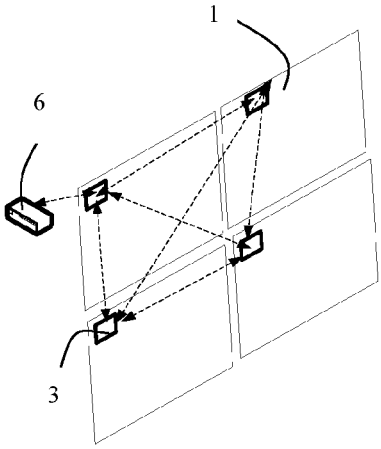
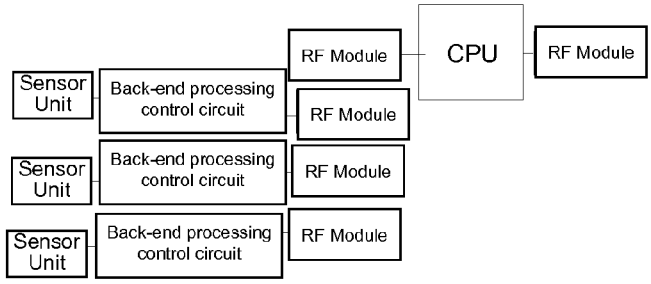
Figure 5A
Figure 5B

SYSTEM AND METHOD FOR DETECTING AND MONITORING SHELL CRACKS ON FREIGHT CONTAINERS

BACKGROUND OF THE INVENTION

1. Field of the Invention

This invention relates to freight containers. Specifically, and not by way of limitation, the present invention relates to a device, method and system for detecting shell cracks on freight containers.

2. Description of the Related Art

In recent years, due to an increasing number of international smuggling occurrences and terrorist attacks, security of freight containers has received more attention. Generally, a freight container is composed of a front end, side walls, a roof, a base structure and a door end. Terrorist may make holes in any of these six surfaces of the containers, which may cause significant problems for container services. In addition, there is a concern on how to prevent criminals from exploiting containers to commit crimes, avoid the necessity of re-encasing goods in the containers that have been examined sealed by customs, and enable a prompt alarm after a container is damaged illegally. Thus, one of the key directions for the containers industry is to design and develop containers that are secure and have an intelligent detection function.

SUMMARY OF THE INVENTION

It is the main aspect of the present invention to provide a device for detecting and monitoring shell cracks on freight containers, which is able to transmit an alarm signal promptly when the shell of a container is cracked.

In another aspect of the present invention, a system for detecting and monitoring shell cracks in freight containers is provided. When the shell of a container is cracked, information may be transmitted promptly to the control terminal, which may decide how to treat the cracked container.

In still another aspect of the present invention, the present invention is a method for detecting and monitoring for shell cracks in freight containers. The method promptly detects a crack in the container and transmits an alarm signal.

The present invention provides a device for detecting shell cracks on a freight container. The device includes a plurality of sensing units, and interface circuit, a receiver module, a CPU and an alarm unit. A signal is generated from the sensing unit and transmitted to the CPU via the interface circuit and receiver module. An output signal from the CPU is then transmitted to the alarm unit. The plurality of sensing units is distributed upon an internal surface of the container. Each sensing unit corresponds to an identification code.

Advantageously, the sensing unit includes an induction board, a detection circuit and a back-end processing control circuit. The induction board includes mesh electrical circuits embedded in a insulated baseboard. The mesh electrical circuits are linked with the detection circuit and the detection circuit is linked with the back-end processing control circuit.

Advantageously, the interface circuit includes a wire or a wireless link wherein the wire link includes a separate wired link or a relay wired link. The wireless link includes a separate wireless link or a relay wireless link.

Advantageously, the sensing unit includes mesh electrical circuits embedded in an insulated baseboard. A first resistor and a second resistor are set in the mesh electrical circuits wherein one end of the second resistor is connected with the first resistor and the other end is grounded. The number of sensing units in the device is N. The first resistors in each of the sensing units are linked together in series via the mesh electrical circuits to form series and parallel circuits containing N frost resistors and N second resistors. The selection of the resistance of the resistors in the sensing unit is based on maximizing the variation of resistance between the ends of the series and parallel circuits formed by N first resistors and N second resistors and the ground when a break occurs in the mesh electrical circuits.

Advantageously, the resistance of each first resistor is different from one another, and the resistance of each second resistor is different from one another.

Advantageously, the resistance of the first resistor and the second resistor in the same sensing unit are equal.

Advantageously, the alarm unit includes a audio and/or visible signal warning device.

Advantageously, the visible signal warning device includes a warning device which can generate an irretrievable visible alarm signal.

Advantageously, the insulated baseboard is composed of wood, PVC plastic, rubber or a composite material. The mesh electrical circuits are composed of conductive lacquer, conductive film, wire, enameled wire or a metal strip of foil.

According to an aspect of the invention, a system for detecting and monitoring for shell cracks on a freight container is provided. The system includes a device adapted to detect shell cracks on a freight container, a memory adapted to store processed detecting signal data, a RF transmitter module adapted to transmit the stored data, and a receiver unit adapted to receive the transmitted data. The device includes a plurality of sensing units, an interface circuit, a receiver module, a CPU and alarm unit. A signal is generated from the sensing unit and transmitted to a CPU via the interface circuit and receiver module. An output signal from the CPU is transmitted to the alarm unit. The plurality of sensing units is distributed upon the internal surface of the container. Each sensing unit corresponds to an identification code.

Advantageously, the receiver includes a data reader.

Advantageously, the data reader includes a fixed reader or a portable reader.

Advantageously, the data reader may be in communication and coupled to a local control terminal via the Internet, an RS232 interface or a WLAN.

Advantageously, the receiver unit includes a remote control terminal coupled to the RF transmitter module via a communication network.

Advantageously, the communication network is a GPRS, a UMTS, or a WLAN.

According to an aspect of the invention, a method for detecting and monitoring for shell cracks on a freight container is provided. The method begins by generating and inductive signal transmitting the inductive signal to a CPU, analyzing and processing the inductive signal and generating an alarm signal based on the result of processing. The conductive signal transmitted to the CPU includes information of a shell crack of the container and the location of the crack.

Advantageously, the inductive signal includes information about the door of the container as to when the door is opened or closed.

Advantageously, the method further comprises storing the processed data of the inductive signal, and transmitting and receiving the stored data.

Advantageously, the transmitted and received stored day is transmitted to a reader.

Advantageously, the method includes transmitting the received data to a local control terminal by the reader via Internet, an RS 232 interface or WLAN.

Advantageously, the transmitted and received stored data includes transmitting and receiving the stored data to a remote control terminal via a GPRS, and UMTS or a WLAN.

Advantageously, the information for the door of the container to be opened or closed includes: information on a opening and/or closing time, times and the duration of the opening status.

Advantageously, the generating inductive signal includes generating an inductive signal where the crack in the container shelf is more than 4 square centimeters large or 20 centimeters long.

Advantageously, the step of transmitting an inductive signal to the CPU includes transmitting the signal by a wired or a wireless link. The wired link includes a relay wired link and a separate wired link. The wireless link includes a relay wireless link and a wireless separate link.

Advantageously, the generating alarm signal is an aural and/or visible alarm signal.

Advantageously, the visible alarm signal includes an irretrievable, visible alarm signal.

Implementing the present invention may execute real-time monitoring over container security and effectively protect the containers from crimes such as smuggling or sabotage.

BRIEF DESCRIPTION OF THE DRAWINGS

FIG. 4A is a diagram illustrating the structure of an exemplary separate wireless interface circuit in accordance with an embodiment of the present invention.

FIG. 4B is a block diagram of the exemplary separate wireless interface circuit illustrated in FIG. 4A.

FIG. 5A is a diagram illustrating the structure of an exemplary relay wireless interface circuit in accordance with an embodiment of the present invention.

FIG. 5B is a block diagram of the exemplary relay wireless interface circuit illustrated in FIG. 5A.

DESCRIPTION OF THE INVENTION

Figure 1:
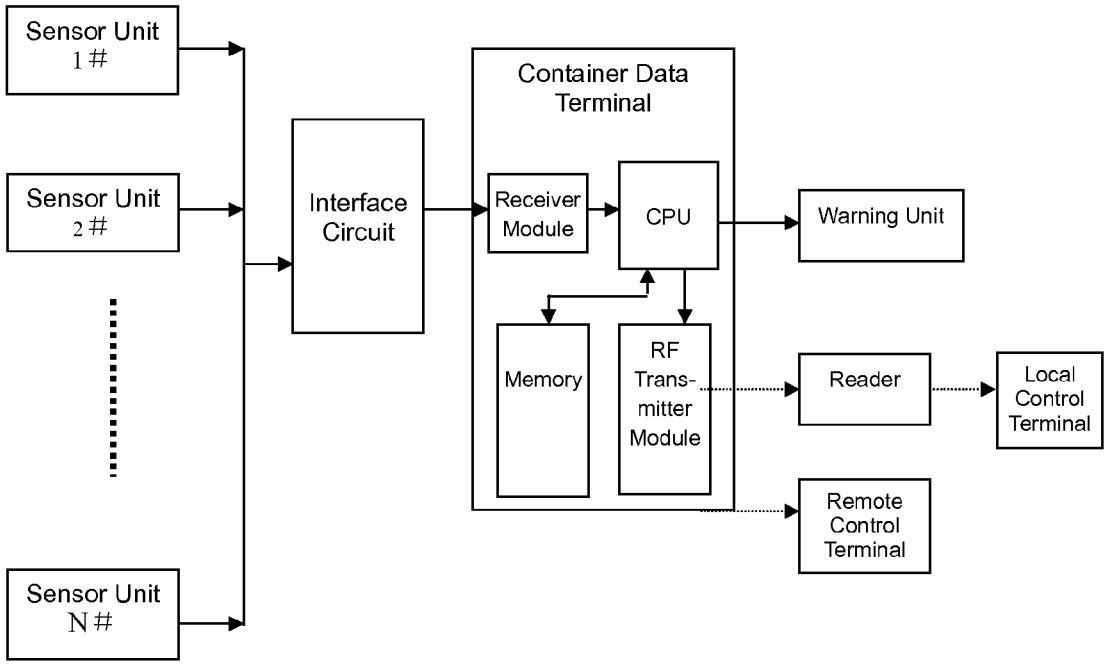
FIG. 1 is a block diagram illustrating a device for detecting shell cracks of freight container in accordance with the present invention.

FIG. 1 is a block diagram illustrating a device for detecting shell cracks on a freight container in accordance with the present invention. As shown in FIG. 1, the device comprises N sensing units. According to the first embodiment of the present invention, these sensing units comprise an induction board, a detection circuit, and a back-end processing control circuit. The induction board includes mesh electrical circuits embedded in an insulated baseboard. The mesh electrical circuits and the insulated baseboard are combined together into one. The motherboard is made of any of wood, PVC, plastic, rubber or composite materials, and is preferably waterproof and antiseptic. The mesh electrical circuits may be composed of conductive lacquer, conductive carbon paste, conductive film, wire, enameled wire or a metal strip of foil.

The induction board, detection circuit and back-end processing control circuit are fixed on six internal surfaces of the container and linked to one another via interfaces, to form an integrated monitoring network of a box shape. For example, the induction board may be designed in a jigsaw puzzle fashion, in which the convex edge of one board in embedded in the concave edge of another board. As a crack (e.g., more than 4 square centimeters larger or 20 centimeters long) occurs in any of six surfaces of the container, the mesh electrical circuits on the induction board are cut off, which leads to a variation of voltage or current. This variation may be detected by the detection circuit.

The inductive signal detected by the detection circuit may then be processed by the back-end processing control circuit of the sensing unit prior to transfer to the container data terminal via the interface circuit. The container data terminal, comprising a receiver module, a CPT, a memory, and an RF transmitter module, my be mounted on the back door of the container. The signal may then be transmitted from the sensing unit to the container data terminal by a wired or a wireless link. In this regard, the interface circuit may be wired or have a wireless mode, as showed in FIGS. 2-5.

Figure 2A:
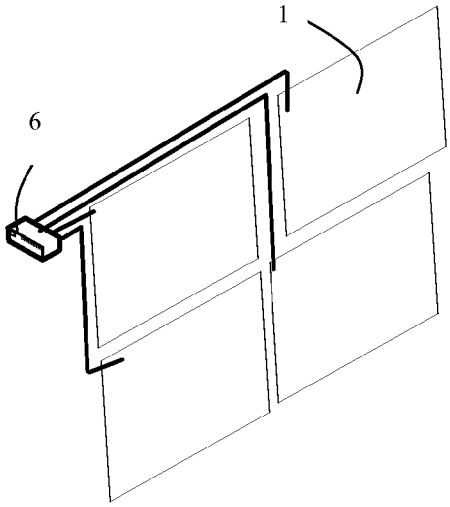
FIG. 2 is a diagram illustrating the structure of an exemplary separate wired interface circuit in accordance with an embodiment of the present invention.
FIG. 2B is a block diagram of the exemplary separate wired interface circuit illustrated in FIG. 2A.
Figure 2B:
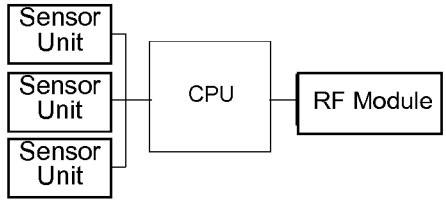

Referring to FIGS. 2A and 2B, in one embodiment of the present invention, the separate wired mode is utilized for the interface circuit. Every sensing unit 1 directly transmits the inductive signal to the receiver module of the container data terminal 6 via a cable. The receiver module may be composed of a matrix circuit. Thus, the output signal from the receiver module includes an ID code of the sensing unit, which may be used to indicate its own location.

Figure 3A:
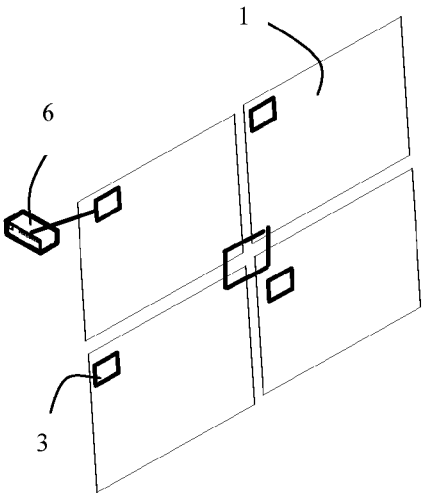
FIG. 3A is a diagram illustrating the structure of an exemplary relay wired interface circuit in accordance with an embodiment of the present invention.
Figure 3B:
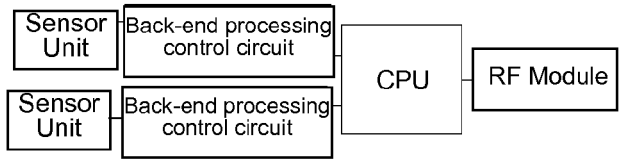
FIG. 3B is a block diagram of the exemplary relay wired interface circuit illustrate in FIG. 3A.

Referring to FIGS. 3A and 3B, in an alternate embodiment of the present invention, the relay wired mode is utilized for the interface circuit, and every sensing unit 1 transfers the inductive signal to the receiver module of the container data terminal 6 via a relay wired link. In this case, sensing units 1 may communicate with each other. Every sensing unit 1 is equipped with a memory for storing the ID code. The transferred inductive signal includes the ID code information of the corresponding sensing unit, which may be used to indicate its own location.

Referring to FIGS. 4A and 4B, in another alternate embodiment of the present invention, the separate wireless mode is utilized for the interface circuit, and every sensing unit 1 directly transmits the inductive signal to the receiver module of container data terminal 6 via an RF transmitter module. In this case, every sensing unit 1 is equipped with a memory for storing the ID code. The transmitted inductive signal includes the ID code information of the corresponding sensing unit, which can then be used to indicate its own location. The receiver module of the container data terminal 6 is the RF receiver circuit.

Referring to FIGS. 5A and 5B, in another embodiment of the present invention, the relay wireless mode is utilized for the interface circuit, and every sensing unit 1 transfers the inductive signal to the receiver module of the container data terminal 6 in a relay fashion. In this case, sensing units 1 may communicate with each other. Every sensing unit 1 is equipped with a memory for storing the ID code. The transferred inductive signal includes the ID code information of the corresponding sensing unit, which may be used to indicate its own location. The receiver module of container data terminal 6 is the RF receiver circuit.

In another alternate embodiment of the present invention, the dimension of a 40 inches container, for example, is about 12 M*2.5 M*3 M, for convenient maintenance. The system is then able to find the location of a crack exactly. Thus, six surfaces of the container may be divided into certain units (for example, a 40 inches container may be divided into approximately 60 units). Where there is a crack, the unit where the crack occurred is detected and located, so that the unit may then be repaired rapidly. For convenience of exactly locating the crack and rapidly repairing the crack, in this embodiment, the six surfaces of the containers are divided into approximately 60 units. The connection and communication between each of the units, between the container unit terminal and the container terminal may be in any way as illustrated in FIGS. 2-5. When a crack occurs in any unit, the container data terminal catches the information exactly, so the location of the crack is rapidly located.

Referring back to FIG. 1, the receiver module of the container data terminal transmits an inductive signal with an ID code information to the CPU. Which then determines the location of a crack based on the accomplished ID code and issues an alarm instruction to the alarm unit.

The alarm unit comprises an audio and/or visible warning device. It can produce an alarm signal (audio or light) instantly to inform and abormity to the carrier, and produce and irretrievable and visible abnormity prompt (such as tungsten filament burn off and bulb fogging caused by high current) on the panel of the container data terminal. Based on that, the operator of the system may judge whether there is a crack present.

Also as shown in FIG. 1, the container data terminal is equipped with a memory and a RF transmitter module. Data of the crack alarm may be stored in the memory after being processed in the CPU. In addition, there is a door sensing unit and other sensing units (such as internal temperature and humidity sensing units) in the container. Data collected by these sensing units may be stored in the memory after being processed in CPU. The data, such as opening/closing time, times and opening duration of the container door, internal temperature and humidity collected periodically, may be combined to form a historical record.

Figure 6:
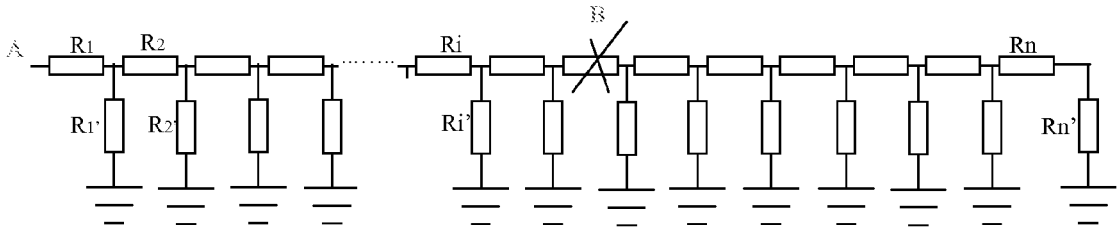
FIG. 6 is a diagram illustrating the structure of an exemplary sensing unit in accordance with an embodiment of the present invention.

In accordance with one embodiment of the present invention, the series resistor in the mesh electrical circuits may act as a sensing unit. As shown in FIG. 6, the surface of a container is divided into n units. Two resistors are coupled in the mesh electrical circuits on each of the units, respectively the first resistor R1 and the second R2. One end of the second resistor R2 is grounded and the other end is connected with the first resistor R1 (j=1, 2 . . . , n). The first resistors R1 of various sensing units are connected in series via the mesh electrical circuits, from R1 to R2 and until Rn. The location of the first resistor R1 and the second R1 in the whole series and paralleled circuits represents their ID code information in the sensing units respectively. In this embodiment, the entire series and apparel circuits comprised of 2n resistors is connected with the interface circuit in the wired mode. One end of the input terminal of the interface circuit is grounded and the other end is connected with the terminal A of the series and parallel circuits.

For example, when a crack occurs in spot B in the circuit, the resistance between A and the ground varies and it is possible to judge where spot B is according to the resistance. When selecting the resistance value of 2n resistors, it is required to follow the principle that when a spot is cracked, its impact on the whole resistance is the greatest. That is to say, when the circuit in the spot B is broken, the resistance between A and the ground varies, which leads to the sharp variation of voltage or current in the interface circuit. Then, the induction signal is transferred to the receiver module in the container data terminal via the interface circuit. The receiver module calculates the whole resistance value at the time, which contains the ID code information of spots B's sensing unit. Then, the receiver module transfers the changed resistance value to the CPU, which considers the value variation and determines the location of the crack. As compared to the previous embodiment wherein sampling is made for a particular board in the present embodiment, the sampling circuit features less wiring and a simplified interface circuit. Diverse closed loops are also formed which provides a great ability to resist electromagnetic disturbance. Thus, if the container shell is cracked, the alarm is given out and the crack location is determined.

In still another alternate embodiment, film resistors are utilized. Alternatively, the resistors may be connected in series in conductive film. Regarding selection of resistor value, besides the principle of maximizing the impact on whole resistance 2n resistors in various sensing units may have the same or different resistance value, where a different value is recommended. It is it different, it is possible to adopt the mode of the first resistor R1 having the same resistor value with the second resistor R in the same sensing unit.

Figure 7:
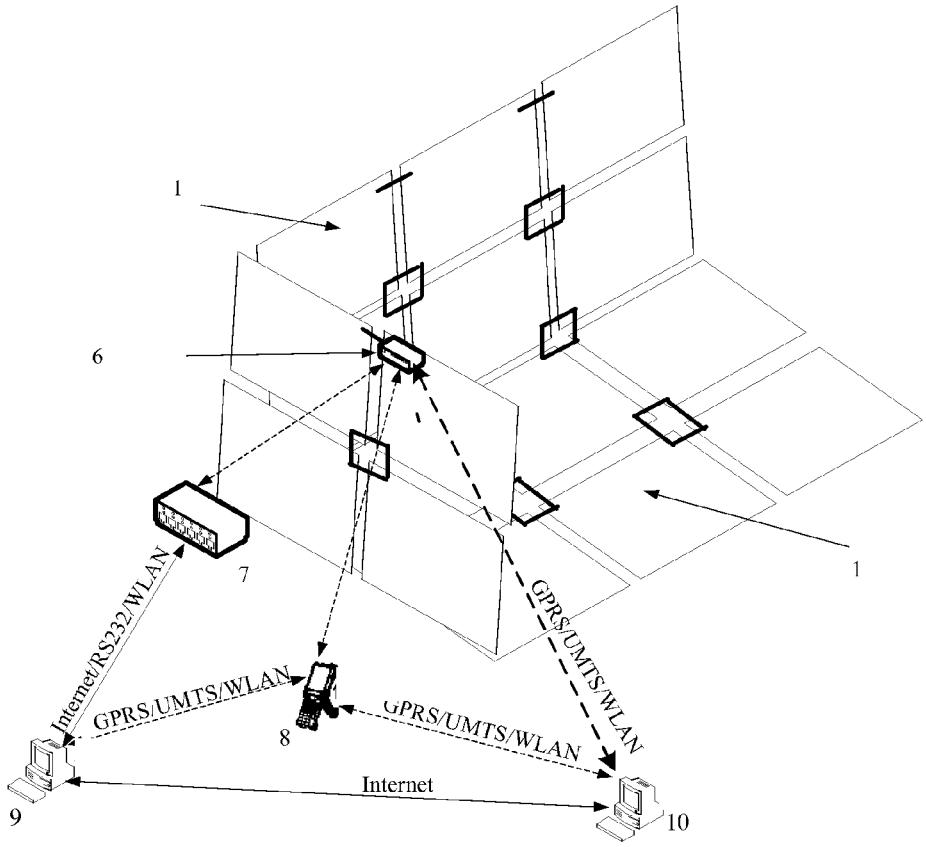
FIG. 7 is a diagram illustrating a system for detecting and monitoring for shell crack of freight containers, in accordance with an ambodiment of the present invention.

FIG. 7 is a diagram illustrating a system for detecting and monitoring shell cracks on a freight container in accordance with an embodiment of the present invention. As shown in FIG. 7, when the container data terminal 5 reaches the coverage range of the reader, the data stored in the contained data terminal 6 may be read out by readers 7 and 8. If there is any alarm information, it will remind the monitoring system to process the unconventionality of the container. The Readers 7 and 8 may also be linked with a local control terminal via the Internet, an RS232 interface or a WLAN and transmit the data to a local control terminal 9. In one embodiment of the present invention, the mobile reader 8 is equipped with an RF transmitter module that is able to transmit the information of the container and alarm data to the remote control terminal 10 and local control terminal 9 via a mobile communication network, such as GPRS, UMTS or WLAN. In addition, while the crack alarm data is stored in the memory of the container terminal, the RF transmitter module may also transmit the information of the container terminal, the RF transmitter module may also transmit the information of the container and alarm data to the remote control terminal 10 via the mobile communication network, such as GPRS, UMTS or WLAN. The remote control terminal 10 then decides how to treat the container.

In general, implementing the container shell crack detecting and monitoring system in accordance with the present invention, a wireless fixed reader 7 or portable reader 8 may read out the data stored in the memory of the container terminal. Furthermore, the RF transmitter module may also transmit directly the data to the local and the remote terminals 9 and 10 via the communication network.

The primary function of the system is to detect the possibility of a crack in a container. Once a crack occurs and is worsened, the detection circuit transmits an alarm signal to the container data terminal (CDT). The RF transmitter module may then transmit the data stored in the container data terminal (CDT) to the remote data terminal wirelessly. In the meantime, the reader may read out the real-time information of the state of the container and historical record from the container data terminal (CDT). Data in the CDT may contain historical and current data concerning the state of the container, such as records about the shipment, including opening and closing of container door, all warning events and the current state of the container.

Figure 8:
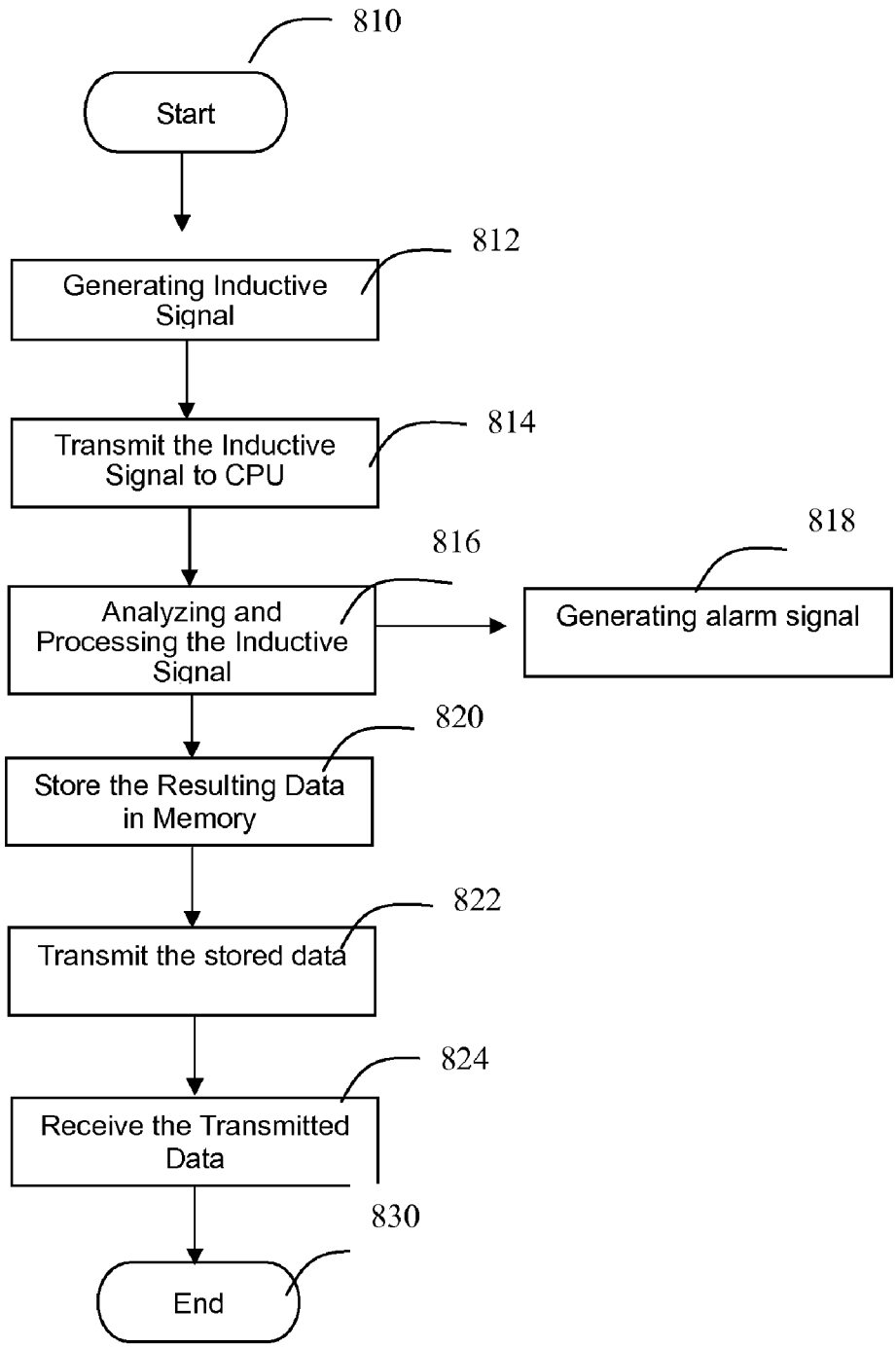
FIG. 8 is a flow diagram illustrating exemplary steps for detecting and monitoring shell cracks of freight containers in accordance with an embodiment of the present invention.

FIG. 8 is a flow diagram illustrating the exemplary steps of detecting and monitoring for shell crack on a freight container in accordance with an alternate embodiment of the present invention. The method 800 begins with step 810. The container shell crack detector begins to work after power up. At step 812, the sensing unit may generate an inductive signal. For example, once a container has a crack of a certain dimension (such as more than 4 square centimeters) or of certain length (such as more than 20 centimeters (in any of the six surfaces of the container, the mesh electrical circuits on the induction board are cut off, causing a variation of the voltage or current, thereby generating an inductive signal. Additionally, when the door of a container is opened or closed, an inductive signal may also be generated. In another embodiment, temperature and humidity sensing units may generate temperature and humidity inductive signals periodically.

Next, at step 814, the inductive signal may be transmitted to the CPU. In accordance with an embodiment of the present invention, the inductive signal detected by the detection circuit may be processed in a back-end processing control circuit and transmitted to the receiver module in the container data terminal via the interface circuit and finally to the CPU. The signal may be transmitted in the separate wired, relay wired, separate wireless or relay wireless mode. In accordance with another embodiment of the present invention, the inductive signal may be transmitted to the receiver module in the Container Data Terminal via the interface circuit and then transmitted to the CPU. In this embodiment, the inductive signal is transmitted to the receiver module by the wired mode.

At step 816, the inductive signal is analyzed and processed by CPU. If the data is about a crack in the container. CPU may judge the crack location and issue an alarm instruction to the alarm unit. In accordance with an embodiment of the present invention, the CPU may also analyze the data of opening/closing of the container door and the internal temperature and humidity with the container. In response to this analysis, the CPU may issue an alarm instruction to the alarm unit if an abnormity occurs.

At step 818 the alarm unit may generate a alarm signal (aural and/or light) to inform of any abnormity to the carrier and produce an irretrievable and visible abnormity prompt (such as tungsten filament burn off and bulb fogging caused by high current) on the panel of the container data terminal.

Next, at step 820, after processing in the CPU, the data may be stored in the memory of the container data terminal. For example, the data may include data of the container shell crack (such as crack location and when the crack is occurred), door opening/closing information (such as opening and closing time, times and opening duration), and internal temperature and humidity (such as the temperature and humidity within a certain period). The data may also be divided into instant data and historical data.

At step 822, the RF transmitter module in the container data terminal may then transmit data stored in the memory. At step 824, the receiver may receive the data stored in the container data terminal. For example, when the container data terminal reaches the coverage range of the reader, the data stored within the container data terminal may be read out by the reader. If there is any alarm information, it will remind the monitoring system to process the abnormality of the container. The reader may also be linked with the local control terminal via the Internet, the RS232 interface or the WLAN, and transmit the data to the local terminal. Furthermore, while crack alarm data is stored in the memory of the container terminal, the RF transmitter module may also transmit the information of the container and alarm data to the remote control terminal via a mobile communication network such as GPRS, UMTS, or WLAN. The remote control terminal 10 may decide how to treat the container in response to the alarm data.

At step 830, the method 800 comes to an end. This may occur when the navigation is finished or the container with the crack or abnormity is repaired or treated. Then, the system may reset and renew its detecting and monitoring feature over the container.

Generally, for a freight container in accordance with the ISO standard, the side wall and the front wall are a corrugated board structure of about 40 mm thick punched from a 2 mm thick steel board, the back door is a corrugated steel board of 50 mm thick, and the floor board is jointed by several boards of about 28 mm thick. In an embodiment of the present invention, the sensing unit and the device for detecting for the shell crack of the container in the monitoring system may be implement in such a fashion that the conductive net is embedded in the shell body of the container to protect the container and detect any crack. Specifically, the conductive net (such as a conductive lacquer, conductive carbor paste, conductive film wire, enameled wire or conductive metal strip of foil with good conductibility) may be arranged on six surfaces of the container. A current flow closed loop is formed between the conductive nut and the back-end processing circuit. Once the container shell is cracked, the current flow closed loop is cut off. The detection circuit then detects the occurrence and transmits an alarm signal to the container data terminal (CDT). After the data is processed, the alarm signal and relevant data may be stored in the memory of the CDT via the RF transmitter module (DTM) and transmitted to the reader within the reader's coverage range or transmitted to the corresponding monitoring center via WAN. The back-end processing control circuit remains dormant at ordinary times and may be activated only if the closed loop is damaged.

The method for detecting for shell cracks within the container primarily adopts different methods (such as conductive lacquer, conductive film, wire, metal strip of foil or others) to protect the integrity of the container and from a protection net for internal walls of the container. The sensing unit generates a signal (such as a cut off/switch signal) when any crack of a specified dimension or length causes damage is detected. The CDT on the container receives the signal, generates an alarm, and stores alarm data in the memory unit.

The present invention incorporates mechanical and electronic information technology together. It can perform a real-time monitoring and rapid detection feature for container security.

While the present invention is described herein with reference to illustrative embodiments for particular applications, it should be understood that the invention is not limited the etc. Those having ordinary skill in the art and access to the teachings provided herein will recognize additional modifications, applications, and embodiments within the scope thereof and additional fields in which the present invention would be of significant utility.

Thus, the present invention has been described herein with reference to a particular embodiment for a particular application. Those having ordinary skill in the art and access to the present teaching will recognize additional modifications, applications and embodiments within the scope thereof.

It is therefore intended by the appended claims to cover any and all such applications, modifications, and embodiments within the scope of the present invention.

What is claimed is:

1. A device for detecting shell cracks of a freight container, the device comprising:

a plurality of sensing units, the plurality of sensing units being distributed in an internal surface of the container, each sensing unit corresponding to an identification code;

wherein the sensing unit comprises:

a plurality of mesh electrical circuits embedded in an insulated baseboard;

a first resistor and a second resistor set in the mesh electrical circuits;

a first end of the second resistor is connected with the first resistor and a second end of the second resistor is grounded;

the number of the sensing units in the device is N, the first resistors in each of the sensing units are linked together in series via the mesh electrical circuits to form series and parallel circuits containing N first resistors and N second resistors;

a selection of a resistance of the resistors in the sensing unit is based on maximizing a variation of resistance between ends of the series and parallel circuits formed by N first resistors and N second resistors and the ground when a break occurs in the mesh electrical circuits;

an interface circuit;

a receiver module;

a computer processing unit (CPU); and an alarm unit;

whereby a signal generated from one of the sensing units is transmitted to the CPU via the interface circuit and receiver module and an output signal from the CPU is transmitted to the alarm unit.

2. The device of claim 1 wherein the resistance of each first resistor is different from each other, and the resistance of each second resistor is different from each other.

3. The device of claim 1 wherein the resistance of the first resistor and the second resistor in the same sensing unit are equal.

4. The device of claim 1 wherein the alarm unit includes an aural or visible signal warning device.

5. The device of claim 1 wherein the insulated baseboard is composed of a material from the group of wood, PVC, plastic, rubber or composite material; and the mesh electrical circuits are composed of a material from the group of conductive lacquer, conductive film, wire, enameled wire or a metal strip of foil.

6. A system for detecting and monitoring for a shell crack of a freight container, the system comprising:

a device adapted to detect shell cracks of a freight container;

a memory adapted to store processed detecting signal data;

a radio frequency (RF) transmitter module adapted to transmit the stored data;

a receiver unit adapted to receive the transmitted data;

wherein the device comprises a plurality of sensing units distributed in an internal surface of the container, an interface circuit, a receiver module, a computer processing unit (CPU) and an alarm unit, each sensing unit corresponds to an identification code;

wherein the sensing unit comprises:

a plurality of mesh electrical circuits embedded in an insulated baseboard;

a first resistor and a second resistor set in the mesh electrical circuits;

a first end of the second resistor is connected with the first resistor and a second end of the second resistor is grounded;

the number of the sensing units in the device is N, the first resistors in each of the sensing units are linked together in series via the mesh electrical circuits to form series and parallel circuits containing N first resistors and N second resistors;

a selection of a resistance of the resistors in the sensing unit is based on maximizing a variation of resistance between ends of the series and parallel circuits formed by N first resistors and N second resistors and the ground when a break occurs in the mesh electrical circuits;

whereby a signal is generated from the sensing unit and transmitted to the CPU via the interface circuit and receiver module and an output signal from the CPU is transmitted to the alarm unit.

7. The system of claim 6 wherein the receiver unit includes a data reader.

8. The system of claim 7 wherein the data reader is a fixed reader or a portable reader.

9. The system according to claim 7 wherein the data reader is coupled to a local control terminal via Internet, an RS232 interface or a wireless local area network (WLAN).

10. The system of claim 6 wherein the receiver unit includes a remote control terminal communication coupled to the RF transmitter module via a communication network.

11. The system of claim 10 wherein the communication network is a general packet radio service (GPRS), an universal mobile telecommunication system (UMTS) or a wireless local area network (WLAN).

* * * * *